US005220248A

United States Patent [19]

Wang

[11] Patent Number: 5,220,248

[45] Date of Patent: Jun. 15, 1993

[54] FLUORESCENT-LAMP PROTECTION DEVICE IN AN ELECTRONIC INSTANT STARTER ASSEMBLY

[76] Inventor: Chin-Tsan Wang, No. 58, Chung Cheng N, Rd., San chung city, Taipei, Taiwan

[21] Appl. No.: 875,759

[22] Filed: Apr. 28, 1992

[51] Int. Cl.[5] ..... H05B 41/14

[52] U.S. Cl. ..... 315/240; 315/360; 315/DIG. 5

[58] Field of Search ..... 315/227 R, 238, 240, 315/241 R, 242, 243, 360, 362, DIG. 5

[56] References Cited

U.S. PATENT DOCUMENTS 4,256,993 3/1981 Morton ..... 315/360 X 4,980,612 12/1990 Bonnilla Gris ..... 315/240

*Primary Examiner*—Steven Mottola

*Attorney, Agent, or Firm*—W. Wayne Liauh

[57] ABSTRACT

A fluorescent lamp protection device, which comprises a solid state timer for controlling the state of a delay- and normal-closed contact so as to control a starter of a fluorescent lamp; the delay-and-normal-closed contact is connected in series with an auxiliary starting capacitor, and then both of them are connected in parallel with an original starting capacitor. The operation power supply of the solid state timer is a D.C. power supply provided by the instant starter of the fluorescent lamp. When the lamp is being turned on, the auxiliary starting capacitor is used for reducing the instantaneous pulse voltage applied to both ends of the fluorescent lamp so as to protect the lamp and to increase the serviceable life thereof.

1 Claim, 2 Drawing Sheets

FLUORESCENT-LAMP PROTECTION DEVICE IN AN ELECTRONIC INSTANT STARTER ASSEMBLY

BACKGROUND OF THE INVENTION

This invention relates to a fluorescent-lamp protection device and particularly to a fluorescent-lamp protection circuit in an electronic instant starter assembly so as to increase the serviceable life of a fluorescent lamp.

A conventional electronic instant starter for a fluorescent lamp has the features of starting a lamp and saving power, but the pulse voltage produced during the instant of starting can cause both ends of a fluorescent lamp to turn black which could damage the electrodes thereof; as result, the serviceable life of a fluorescent lamp would be shortened. Consequently, consumers would not accept such an instant starter no matter how the producer emphasizes the starter speed and the power-saving features thereof, and therefore marketability is limited.

In addition to the above mentioned drawbacks which cause a fluorescent lamp to have a short serviceable life, the instant starter would also have a shorter serviceable life because of the pulse voltage during the starting moment which could damage the starting capacitor; moreover the electronic parts in the starter assembly would also have a shorter serviceable life. If all the aforesaid drawbacks of a conventional fluorescent lamp can not be improved, the usefulness of the conventional instant starter would be reduced considerably.

SUMMARY OF THE INVENTION

The primary object of the present invention is to eliminate the drawbacks of the prior art as mentioned above by providing a protection device, which is particularly useful to an instant starter of a fluorescent lamp so as to prevent both ends of a fluorescent lamp from turning black as a result of impact of the pulse voltage of the instant starter.

Another object of the present invention is to provide a protection device for the electrodes of a fluorescent lamp so as to prevent the electrodes from being damaged by a high pulse voltage. Since the electrodes of a fluorescent lamp are made of alkaline oxide, a high surge current caused by a high pulse voltage would damage the electrodes, and shorten the serviceable life of a fluorescent lamp. By means of the present invention, such surge pulse voltage can be lowered adequately, and therefore the electrodes of a fluorescent lamp can be protected completely.

Still another object of the present invention is to provide a protection device to protect a starter of a fluorescent lamp to have a longer serviceable life. According to the circuit of the present invention, the starting circuit (especially the starting capacitor) of the starter will not be damaged by a surge pulse voltage.

The other objects of the present invention will be described as follows with the accompanying drawings of an embodiment thereof.

DETAILED DESCRIPTION

Figure 1:
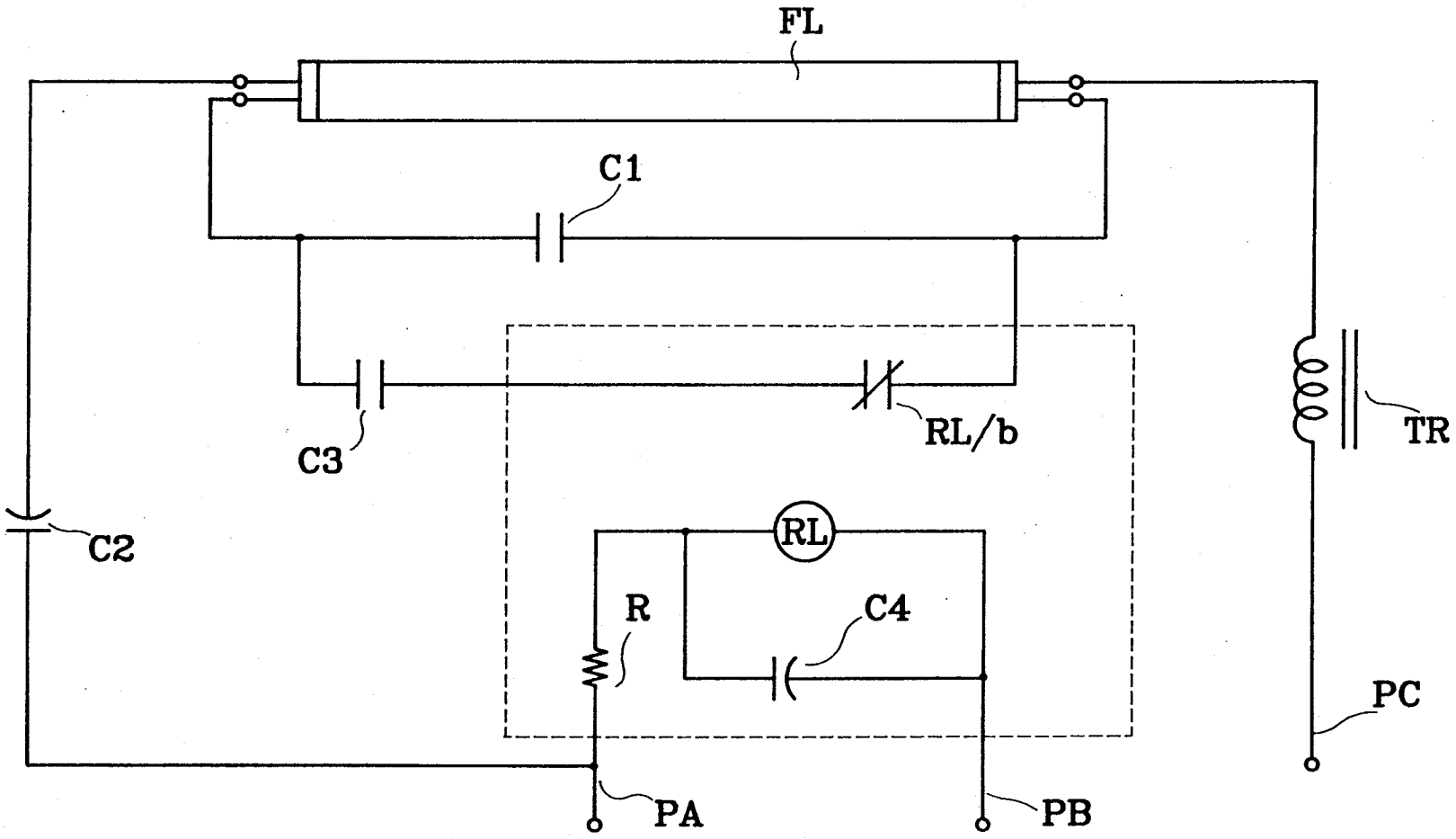
FIG. 1 is a schematic diagram of a solid-state timer RL/b according to the present invention connected with a conventional fluorescent lamp circuit.
Figure 2:
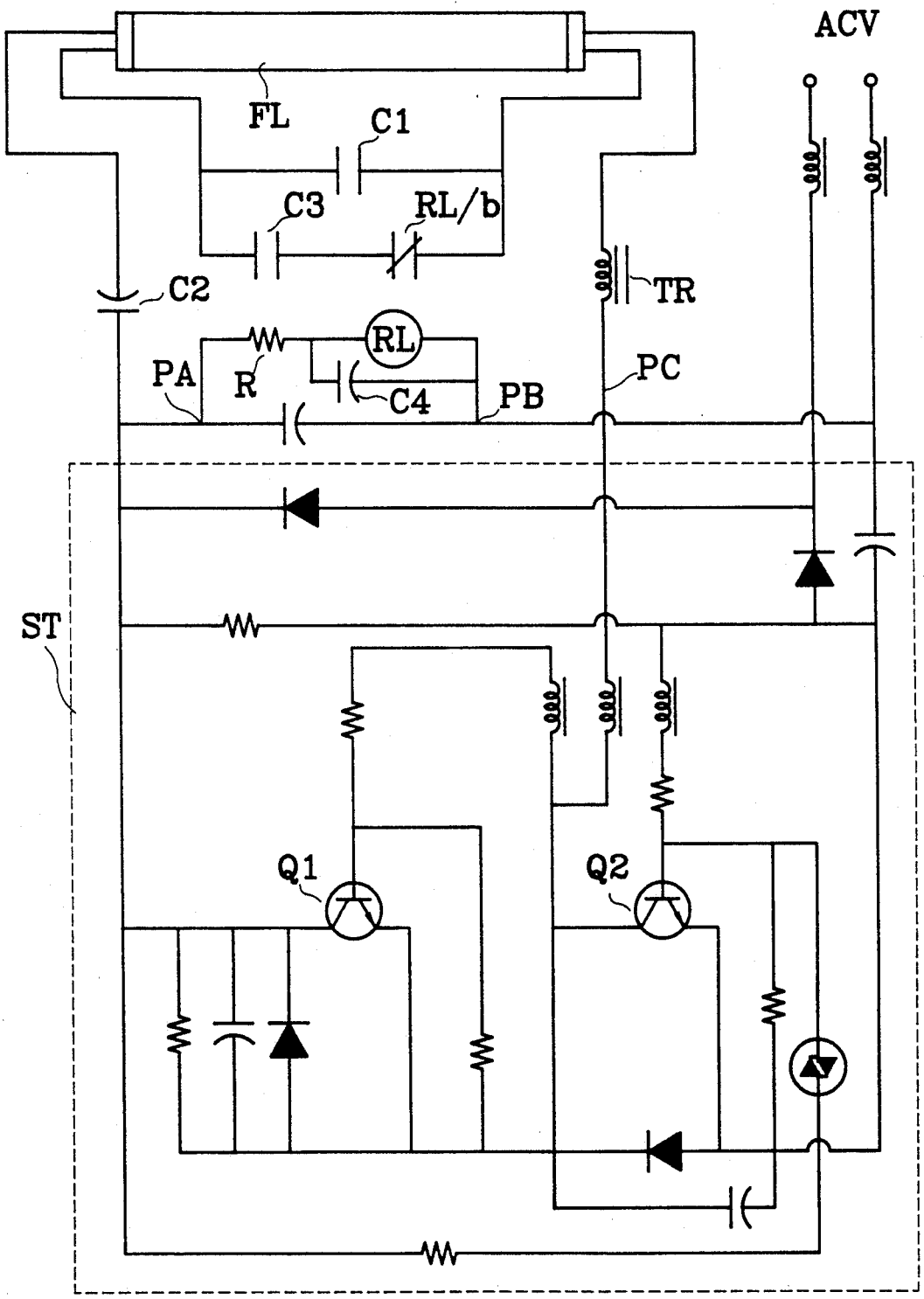
FIG. 2 is an integral circuit according to the present invention, including the protection device, the starter and the fluorescent lamp.

Referring to FIG. 1, one electrode of a fluorescent lamp is connected with a capacitor C2 in series, while the other end of the lamp is connected with a choke coil TR. Two terminal points PA and PC are connected to a conventional starter of a fluorescent lamp (as shown in FIG. 2). Two electrodes on both ends of the fluorescent lamp are connected in parallel with a capacitor C1, which is a original starting capacitor. According to the present invention, a capacitor C3, an auxiliary starting capacitor, is connected in series with a delay-normal-closed contact RL/b; then, they are connected in parallel with the capacitor C1. A solid state timer includes a resistor R, a capacitor C4 and a relay RL; the relay RL is used for controlling the delay-and-normal-closed contact RL/b to turn on or off. Both terminals PA and PB of the normal-closed contact RL/b are connected with two terminals of D.C. (direct current) power supply on the starter respectively.

When the power supply is turned on, the voltage applied to the two terminals will cause the relay RL to be energized in a delay manner. After the auxiliary starting capacitor C3 is connected in parallel with the starting capacitor C1, the total capacitance is increased; during the starting period, the instant pulse voltage applied to both ends of the fluorescent lamp will be reduced to a normal voltage; then, both ends of the fluorescent lamp would not produce a purple arc which causes these ends to become black after a period of time.

As soon as the fluorescent lamp is lit up, the solid state timer will, within about one second, cause the delay-and-normal-closed contact RL/b to turn off; in that case, the auxiliary starting capacitor C3 will be disconnected from the original starting capacitor C1 without affecting the rated output of the starter.

FIG. 2 illustrates the solid-state timer of the present invention and the conventional starter being combined together. The starter ST includes two transistors Q1 and Q2 and other electronic parts. The starter ST is merely an embodiment of a conventional circuit thereof. The delay-and-normal-closed contact RL/b is to be turned off upon the fluorescent lamp being lit up, and it would not affect the output of the starter. If the delay-and-normal-closed contact RL/b remains in normal closed condition, the output of the starter will be increased considerably to cause the transistors Q1 and Q2 to be burnt out. One output terminal PC of the starter ST is connected with a chock coil TR and to one electrode at one end of the fluorescent lamp FL. The starter also has a D.C. output, which is connected across two terminals PA and PB of the solid state timer.

I claim:

1. A fluorescent-lamp protection device in an instant starter assembly;

said fluorescent lamp being adapted to be started by means of an electronic instant starter and having two electrodes at its axial ends;

an original starting capacitor connected in parallel with said fluorescent lamp at said electrodes;

said electronic instant having two DC-powered terminals one of which being connected with a choke coil and one of said electrodes;

said protecting device comprising:

a solid-state timer, which is connected to one of said DC-powered terminals of said electronics instant starter to receive power therefrom;

an auxiliary starting capacitor which is connected in series with a delay-and-normal-closed contact and in parallel with said original starting capacitor, said delay-and-normal-closed contact being controlled by said solid-state timer; and said solid-state timer comprising a relay 1 and a capacitor which are connected in parallel, said timer being so designed such that when said instant electronic starter supplies DC power to said solid-state timer, said delay-and-normal closed contact is initially in a closed position so as to allow electric current to pass through both said auxiliary starting capacitor and said original starting capacitor, but after a pre-determined period of time, which is about one second after said fluorescent is lit up, said solid-state timer will cause said delay-and-normal-closed contact to be in an open position thereby shutting off current to said auxiliary starting capacitor.

* * * * *